US005490308A

United States Patent [19]

Huber et al.

[11] Patent Number: 5,490,308

[45] Date of Patent: Feb. 13, 1996

[54] MONITORING THE UNIFORMITY OF TOWS

[75] Inventors: Bernd Huber; Richard Neuert, both of Kelheim, Germany

[73] Assignee: Hoechst Aktiengesellschaft, Germany

[21] Appl. No.: 235,185

[22] Filed: Apr. 29, 1994

Related U.S. Application Data

[63] Continuation of Ser. No. 716,057, Jun. 17, 1991, abandoned.

[30] Foreign Application Priority Data

Jun. 19, 1990 [DE] Germany ..... 40 19 469.8

[51] Int. Cl.[6] ..... D01G 23/06

[52] U.S. Cl. ..... 19/239; 19/65 T

[58] Field of Search ..... 19/0.23, 65 T, 19/150, 239, 300, 0.22; 28/172.2, 240–242, 203.1, 247, 248, 282; 73/159, 160

[56] References Cited

U.S. PATENT DOCUMENTS

| | | | |
|---|---|---|---|
| 2,930,102 | 3/1960 | Hitchin et al. | 28/241 |
| 3,126,579 | 3/1964 | Janszen | 28/241 |
| 3,231,958 | 2/1966 | Chadwick | 19/150 X |
| 4,477,398 | 10/1984 | Henry et al. | 28/241 X |
| 4,974,296 | 12/1990 | Vidler | 19/239 |
| 5,027,484 | 7/1991 | Baba | 28/185 |
| 5,146,651 | 9/1992 | Duffy et al. | 19/65 T |

FOREIGN PATENT DOCUMENTS

| | | | |
|---|---|---|---|
| 0212094 | 2/1957 | Australia | 19/239 |
| 6055607 | 12/1985 | Japan | 19/239 |
| 0941439 | 7/1982 | U.S.S.R. | 19/239 |
| 1516532 | 10/1989 | U.S.S.R. | 19/300 |
| 2081758 | 2/1982 | United Kingdom | 19/239 |

*Primary Examiner*—C. D. Crowder
*Assistant Examiner*—Ismael Izaguirre
*Attorney, Agent, or Firm*—Connolly & Hutz

[57] ABSTRACT

A method monitors and measures the uniformity of tows with mechanical sensing elements in the course of production on a tow line. The tension of the running tow is measured upstream of a transport roll arrangement and is utilized as a measure of the uniformity of the tow. Irregularities in the tow result in tow tension determination outside a predetermined tension range, and when the determined tension measurement is outside that range the irregular tow portions are remove. Also, the frequency of tow tension determination outside a predetermined range may be used as an indication of tow quality and for removing substandard tows.

4 Claims, 1 Drawing Sheet

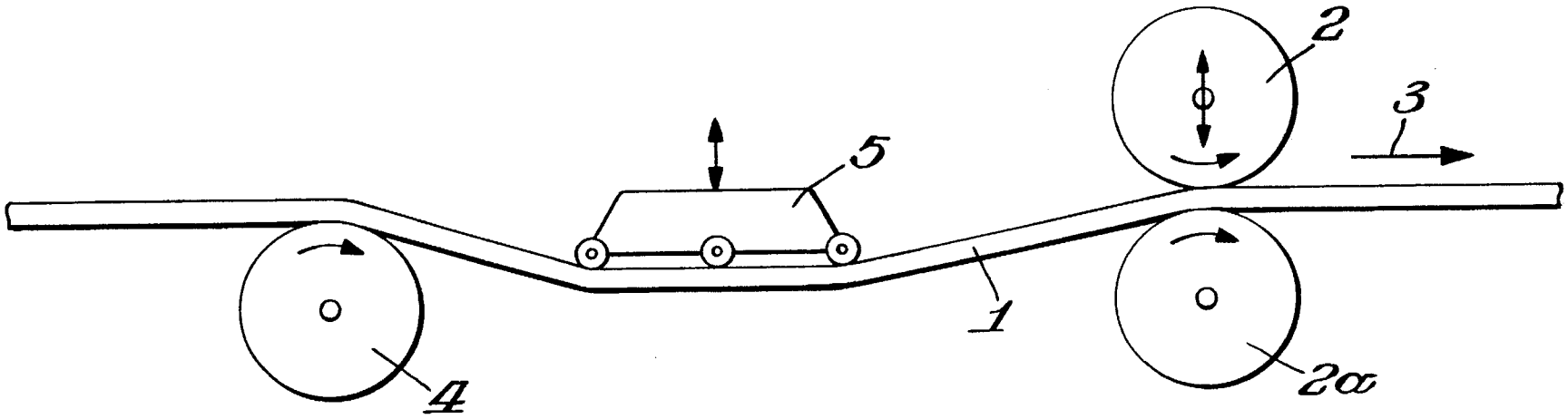
2
3
2α
1
5
4

MONITORING THE UNIFORMITY OF TOWS

CROSS-REFERENCE TO RELATED APPLICATION

This application is a continuation, of application Ser. No. 07/716,057, filed on Jun. 17, 1991, now abandoned.

BACKGROUND OF THE INVENTION

The present invention relates to a method for monitoring or measuring the uniformity of tows with mechanical sensing elements in the course of production on a tow line.

In the production of synthetic fibers it is necessary to confer the desired textile properties on the spun filaments in a number of aftertreatment steps. Examples of aftertreatment steps which are generally necessary are drawing, setting, crimping and, where appropriate, cutting the continuous filaments into staple fibers. These aftertreatment steps are in general carried out in industry on tow lines by first combining the filaments from a plurality of spinnerets to form a tow which is then deposited in cans and then combining a plurality of these tows and subjecting them together on a tow line to the abovementioned aftertreatment steps of drawing, setting, crimping, etc. The tows aftertreated at the same time in this manner contain a very large number, generally from several hundred thousand to several million, individual filaments.

Especially tows which are subsequently to be further processed as converter tows, stretch-breaking tows or filling fiber tows must be of uniform quality and comprise in particular a constant number of filaments. Any change in the thickness of a tow leads to nonuniformity and hence a quality defect in the end product.

For technical reasons, for example because the canned tows of freshly spun filaments are not infinitely long, imperfections due to the running out of supply cans and the then necessary recruitment of replacement tows are unavoidable. Similarly, spinning-out problems which can lead to the breakage of individual filaments and to clumping and blob formation produce hard places in the tow and reduce the quality thereof. It is therefore necessary to monitor the tows for irregularities in order that the proportion of end product which is of inferior quality due to the presence of an irregularity may be eliminated from the production process. The tows are usually monitored visually by the operating personnel. In specific areas it is also already possible to use automatic equipment which is supposed to minimize the effects of tow irregularities on the end product.

Apparatus for this purpose is known for example from German Auslegeschrift 2,144,104, German Offenlegungsschrift 2,400,293 and German Patent No. 11,208. The apparatus known from German Auslegeschrift 2,144,104, and German Offenlegungsschrift 2,400,293 comprises sensing rollers which sense the thickness of the tow. In the apparatus of German Patent 11,208 this function is performed by a so-called sensing saddle, which is intended to be thrown upward by thick places in the tow.

German Offenlegungsschrift 3,306,687 describes an apparatus for bringing together a plurality of synthetic fiber tows upstream of a crimping box by means of pivotable deflecting rolls, said apparatus comprising tow tension measuring and control units. The tow tension is measured here only to provide automatic control of the deflecting rolls, so that the bringing together of the tows can be optimized. The apparatus does not have the purpose of detecting the quality of the tows.

SUMMARY OF THE INVENTION

By contrast, the present invention has for its object to provide a method whereby the quality of a synthetic fiber tow can be monitored and, if desired, evaluated. It has been found, surprisingly, that this object is achieved by a continuous monitoring of the tension of the synthetic fiber tow.

The present invention accordingly provides a method for monitoring or measuring the uniformity of synthetic fiber tows with mechanical sensing elements in the course of production on a tow line, wherein the tension of the running tow is measured upstream of a roll arrangement transporting the tow at a defined speed and is utilized as a measure of the uniformity of the tow.

Roll arrangements which on tow lines transport the tow at a defined speed are designed in such a way that, as a result of friction at the roll surface, the tow runs over the rolls at virtually the circumferential speed of the rolls.

Single rolls are in general not sufficient to impart a defined transport speed to a tow, since the friction between the tow and the roll surface is not sufficient and therefore usually permits a certain amount of slippage.

Roll arrangements which are capable of conferring a defined speed on a tow therefore contain two or more —usually for example up to seven (in septets)—rolls which are arranged either for the tow to pass through them in succession with a very large wrap angle or as pairs of squeeze rolls.

Pairs of squeeze rolls consist of a fixed roll and a mobile roll which presses with a great deal of force against the fixed roll. The tow to be transported is drawn into the nip between the pair of squeeze rolls and is transported at the circumferential speed of the squeeze rolls. This produces upstream of the squeeze rolls a tow tension which results from the overall construction of the tow line and which under standard conditions will fluctuate randomly about a standard value. Roll arrangements which are capable of conferring a defined transport speed on a tow will hereinafter be referred to as transport roll arrangements. Transport roll arrangements are found in many tow handling machines as intake rolls, for example in dryers, crimping boxes, tow-breakers, cutting machines, etc.

BRIEF DESCRIPTION OF THE DRAWING

The single FIGURE of drawing schematically illustrates a running tow and determination of the tension in the tow portion between spaced apart rollers.

DETAILED DESCRIPTION OF THE INVENTION

Referring in more particularity to the drawing, a running tow (1) is driven by squeeze rolls (2) and (2*a*) in the direction indicated by arrow (3). The running tow is supported by supporting roll (4), and a dancer roll (5) is positioned between the squeeze rolls (2, 2*a*) and the supporting roll (4) in contact with the running tow. The dancer roll (5) is capable of moving up and down and acts as a sensor for measuring the tension in the running tow.

It has been found that the passage of tow irregularities through the nip of the rolls (2, 2*a*) results in sudden changes of the tension in the running tow (1). These changes are detected by the tension-sensor (5). Hence, the occurrence of such changes in tension is an indicator of tow irregularities, and the corresponding signal of the tension sensor (5) is used to effect removal of the faulty place of the tow.

Depending on the relation of the tension of the tow upstream and downstream of rolls (2, 2*a*) the change in tension occurring at the place of the sensor (5) may be positive or negative.

The tow tension is therefore preferably measured within a zone which is upstream of the intake rolls of a tow treatment machine, for example a tow-to-top converter or a stuffer box, and which is equipped with a tension measuring instrument of a design known per se. If a fault in the synthetic fiber tow in the form of a thicker or thinner piece of tow should pass into the intake rolls (transport roll arrangement) of the monitored machine, this fault will show up as a change in the tow tension upstream of the intake rolls, which will be readily measurable with tension measuring heads known per se. If the transport roll arrangement consists of a multiple set of rolls, a fault in the form of a thick place in the tow will lead to a tension increase and a thin place in the tow will lead to a tension decrease. If the transport roll arrangement consists of a pair of squeeze rolls, then a thick place in the tow on passing through the nip will lead to a tension increase, and a thin place in the tow to a tension decrease, provided the tow is also held under tension downstream of the pair of squeeze rolls. If the tow is no longer under tension downstream of the squeeze rolls, which is the case for example downstream of the intake rolls of a stuffer box (crimping box), the reverse will apply: a thick place in the tow will lead to a tension decrease and a thin place will provoke a tension increase. Even so-called "hard places", which are formed for example due to an accumulation of broken filaments which have coalesced to form a hot-like polymer blobs, will on passing through the squeeze type intake rolls of a monitored machine, for example a stuffer box, lead to a sharp tension increase in the tow upstream of the intake rolls if downstream of the squeeze rolls (as in a stuffer box) the tow is no longer under tension.

Depending on the length of the faulty area in the synthetic fiber tow, shorter or longer tension changes will result upstream of the intake rolls. The frequency and length of tension deviations thus constitute a reliable measure of the quality of the monitored synthetic fiber tow.

The measured results can be evaluated in various ways, according to what information is desired about the quality of the tow. If, for example, faulty areas in the tow are to be categorically eliminated prior to further processing, a positive or negative tension change can be utilized for example for immediately switching off the tow transport. If the faulty area is to be channelled out of the product stream at a suitable point, it can be marked for example with a sighting color when the change in tension occurs. However, the tension signal can also start for example a timer which, as a function of the tow speed, controls the channelling-out of the faulty product.

For example, an alarm signal triggered by the tension change can be utilized to switch on a light within the area of the tow treatment apparatus, for example a crimping machine, downstream of the pair of rolls to indicate to the operative that an unacceptable fault has formed in the tow. At the same time a signal can be triggered, for example within the area of the tow plaiter, and, after an appropriate time for the fault to pass through the setter, a signal can be triggered upstream of the cutting machine to make it possible to interrupt the canning process in due time and to eliminate the off-spec portions resulting from the tow non-uniformity. The signal triggered by the change in tension can also be utilized, as mentioned earlier, to mark the faulty area in the tow with a sighting color. The off-spec portions can then be removed by hand or automatically, for example upstream of the tow depositor or at the cutting machine.

To prevent the minute random tension changes in the tow from triggering the measures which are designed to deal with a fault, preferably only those positive and/or negative tension changes in the tow are evaluated which are beyond a predetermined positive and/or negative threshold level, i.e. outside a predetermined threshold window. The threshold is set so as to be above the random tension changes which occur during standard operation.

However, the method of the present invention is suitable not only for triggering certain alarm devices or fault measures in the event of problems occurring in the tow but also for counting or integrating the tension changes by frequency and/or length. The resulting value can be standardized in terms of unit running time or length of the tow and then represents a measure of the average tow quality within the measured interval.

If an analog signal is derived from the tension measuring instrument, every change in the thickness of the tow can be continuously monitored on a recorder. Here too it is possible to define a limit for the analog signal at which the above-described fault measures are triggered.

The measuring of the tow tension can take place continuously, i.e. without interruption, in which case the tension signal obtained can be used for the continuous monitoring of the tow quality. However, the measuring can also take place intermittently at short intervals. This embodiment is of advantage if, for example, a single evaluating and control means is provided for a plurality of measuring sites. The evaluating computer then acts in a quasi time sharing mode.

Advantageously, the evaluation of the signal sequence for determining the tow quality is effected by a computer which can output the results in real time and hence makes process control possible, if desired.

To carry out the method of the present invention, it is possible to use any known means for measuring the tension of fiber tows. Of particular suitability are those means which employ a dancer roll, i.e. a mobile roll arranged between two fixed rolls which rests with pressure on the tow. This dancer roll can be controlled in various ways, it being possible for example to form a relatively long loop of tow by means of the dancer roll, so that the tow wraps around the dancer roll to about 180°. The dancer roll is held in this position by spring force, so that any tension change in the tow leads to a change in the position of the dancer roll. The change in the position of the dancer roll is then converted in a conventional manner into an electrical analog or digital signal and further processed as described above. However, a dancer roll can also be operated for example in a manner such that it is kept by a constantly measured force in a position in which it deflects the moving tow only relatively slightly, for example by an angle between 20° and 45°. The force required for maintaining this position is constantly measured and converted in a conventional manner, for example with an electronic tensiometer, into an electrical signal which is evaluated as described above.

What is claimed is:

1. A method for monitoring the uniformity of tows with mechanical sensing elements in the course of producing a tow line comprising the steps of transporting a tow at a predetermined speed by a roller arrangement, measuring tow tension upstream of the roller arrangement, detecting any irregularity of the tow passing the roller arrangement by detecting tow tension increases and decreases, establishing predetermined positive and negative tow tension thresholds, indicating an irregularity in the tow when the measured tension exceeds either threshold, and triggering fault measures when either threshold is exceeded.

2. A method as in claim 1 wherein the roller arrangement comprises the intake rolls of a tow treatment apparatus.

3. A method for monitoring the uniformity of tows with mechanical sensing elements in the course of producing a tow line comprising the steps of transporting a tow at a predetermined speed by a roller arrangement, measuring tow tension upstream of the roller arrangement, detecting any irregularity of tow passing the roller arrangement by detecting tow tension increases and decreases, counting the number of tow increases and decreases over the given length of tow, and utilizing the number of tow increases and decreases over the given length of tow as a measure of tow quality.

4. A method as in claim 3 wherein the roller arrangement comprises the intake rolls of a tow treatment apparatus.

* * * * *